US008298053B2

(12) United States Patent
Parry

(10) Patent No.: US 8,298,053 B2
(45) Date of Patent: Oct. 30, 2012

(54) OMNIDIRECTIONAL VENT CAP

(76) Inventor: Ronald C. Parry, North Vancouver (CA)

( * ) Notice: Subject to any disclaimer, the term of this patent is extended or adjusted under 35 U.S.C. 154(b) by 856 days.

(21) Appl. No.: 11/720,048

(22) PCT Filed: Nov. 22, 2005

(86) PCT No.: PCT/CA2005/001778

§ 371 (c)(1),
(2), (4) Date: Jun. 28, 2007

(87) PCT Pub. No.: WO2006/056056

PCT Pub. Date: Jun. 1, 2006

(65) Prior Publication Data

US 2008/0096480 A1 Apr. 24, 2008

Related U.S. Application Data

(63) Continuation-in-part of application No. 10/994,468, filed on Nov. 23, 2004, now abandoned.

(51) Int. Cl.
*F23L 17/02* (2006.01)

(52) U.S. Cl. ..... 454/38; 454/33

(58) Field of Classification Search ..... 454/4, 10, 454/33, 38

See application file for complete search history.

(56) References Cited

U.S. PATENT DOCUMENTS

| | | | | |
|---|---|---|---|---|
| 55,094 | A | 5/1866 | Hardy | |
| 3,302,552 | A | 2/1967 | Walsh | |
| 3,345,931 | A | 10/1967 | Walsh | |
| 3,347,147 | A * | 10/1967 | Howard | 454/38 |
| 3,382,792 | A | 5/1968 | Howard | |
| 3,509,811 | A * | 5/1970 | Topp | 454/38 |
| 3,874,363 | A * | 4/1975 | Biedenbender et al. | 126/85 B |
| 4,142,457 | A * | 3/1979 | Zaniewski | 454/38 |
| 4,342,258 | A * | 8/1982 | Zaniewski | 454/16 |
| 4,531,455 | A | 7/1985 | Palmer | |
| 4,603,619 | A | 8/1986 | Amphoux | |
| 7,001,266 | B2 * | 2/2006 | Jones et al. | 454/364 |

* cited by examiner

*Primary Examiner* — Steven B McAllister
*Assistant Examiner* — Samantha Miller
(74) *Attorney, Agent, or Firm* — Chernoff Vilhauer McClung & Stenzel LLP

(57) ABSTRACT

An omnidirectional vent cap for venting holding tanks is provided. By providing a 360 degree venturi channel, the present invention can use a small movement of air to reduce the air pressure above the exhaust port to draw out vapors or gasses. Since the device is symmetrical about the central axis the movement of air can be from any direction relative to the device.

11 Claims, 8 Drawing Sheets

OMNIDIRECTIONAL VENT CAP

CROSS-REFERENCE TO RELATED APPLICATIONS

This application is a continuation-in-part of U.S. patent application Ser. No. 10/994,468 filed Nov. 23, 2004, which is pending.

TECHNICAL FIELD

The application relates to the field of ventilating caps for ventilating exhaust vents, stacks, chimneys or roof top vents for recreational vehicle holding tanks and the like; and to devices for preventing downdrafts or wind from blowing down a stack or chimney.

BACKGROUND

Ventilator caps are widely used to facilitate venting from gas exhaust outlets on building roofs and transportation vehicles. For example, recreational vehicles utilize a holding tank for storage and processing of sewage (black water) and/or grey water. Such holding tanks are generally vented to the exterior atmosphere by a vent pipe which typically exits the vehicle through the roof of the vehicle. A cap is provided on the vent pipe to prevent objects from entering the pipe. However, the unpleasant odors can accumulate in the holding tank and seep back into the living area of the vehicle.

To improve and facilitate the exhaust of gases from the holding tank, a rotating vent cap resembling a wind vane has been used to take advantage of wind movement. Such vent caps are pivotally connected to the outlet of the vent pipe and have a vane which causes the outlet opening to point downwind, thereby drawing vapors from the holding tank. A drawback of such vent caps however is that they require a certain minimum wind velocity to function effectively, in particular at least enough wind velocity to pivot the wind vane. In the absence of that minimum wind force, the device may not function.

Other venting apparatus are shown in the following U.S. Pat. No. 55,094 Hardy; U.S. Pat. No. 3,302,552 Walsh; U.S. Pat. Nos. 3,347,147 and 3,382,792 Howard; U.S. Pat. No. 3,509,811 Topp; U.S. Pat. No. 4,531,455 Palmer; and U.S. Pat. No. 4,603,619 Amphoux.

It is therefore desired to provide a vent cap which functions to improve the exhaust of gasses from holding tanks, attics, stacks, chimneys or the like omni-directionally with no moving parts and even in conditions of low velocity air movement.

SUMMARY OF INVENTION

An omnidirectional vent cap for venting holding tanks is provided. The invention provides a vent cap for venting an exhaust gas passage, comprising: i) a base having a central opening for communicating with the exhaust gas passage and an outer perimeter, and a ramp surface extending between the outer perimeter and the central opening, the ramp surface sloping upwardly from the outer perimeter to the central opening; ii) a top cover element supported above the base, having a diameter greater than the diameter of the central opening, having an outer edge and a convex lower surface extending at its lowest point below the outer edge to thereby in combination with the base cause a low pressure effect above the exhaust gas passage when air moves through the vent cap; and iii) means for supporting the top cover element above the base.

According to one aspect of the invention the ramp surface has an increasing slope as the distance from the central opening decreases. According to a further aspect the invention further comprises a plurality of spaced, radially extending vanes projecting upwardly from the upper ramp surface. According to a further aspect the top cover element can be removed and replaced onto the base.

By providing a 360 degree channel, the present invention can use a small movement of air to significantly reduce the air pressure above exhaust port to draw vapors or gasses from the exhaust pipe. Since the device is symmetrical about the central axis the movement of air can be from any direction relative to the device.

BRIEF DESCRIPTION OF DRAWINGS

In drawings which illustrate a preferred embodiment of the invention.

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Figure 1:
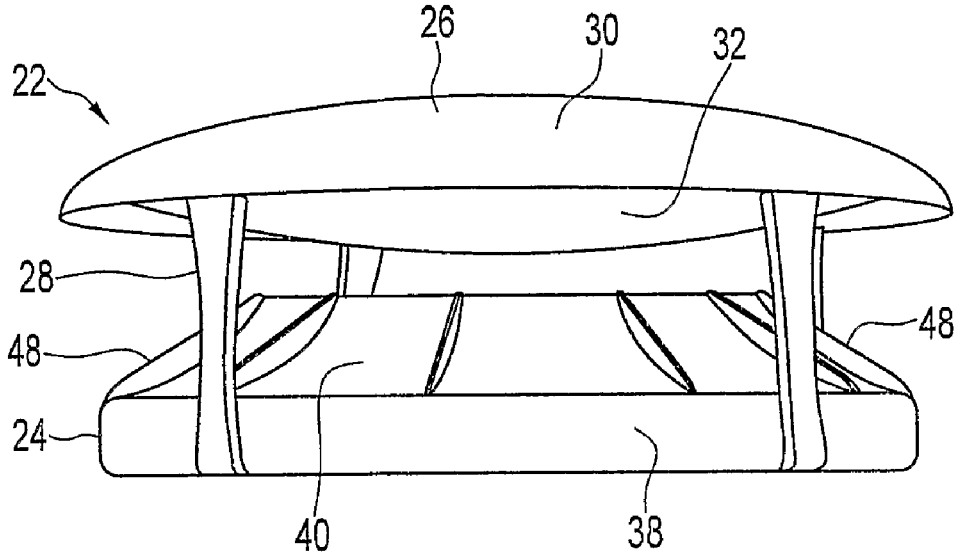
FIG. 1 is a perspective view of a first embodiment of the vent cap of the invention.
Figure 2:
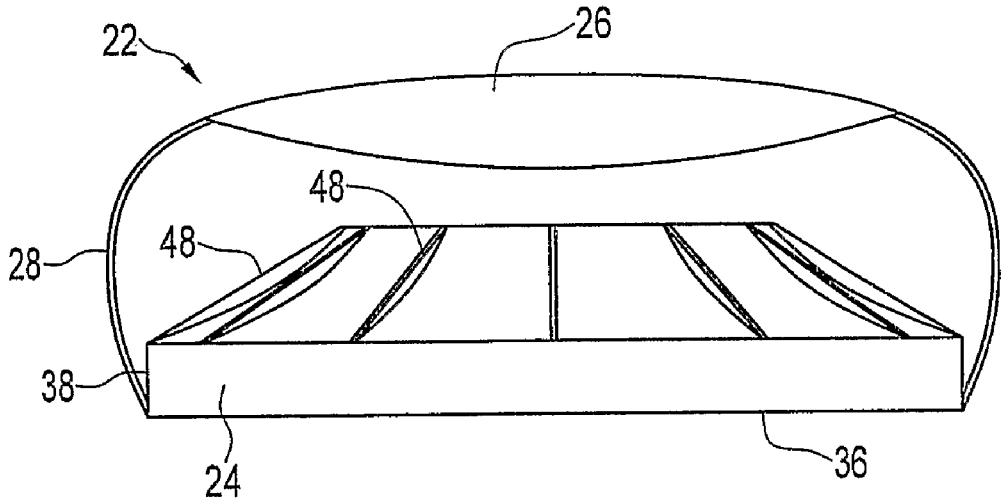
FIG. 2 is a front elevation view of a second embodiment of the vent cap having a variation in the shape of the support legs.
Figure 7:
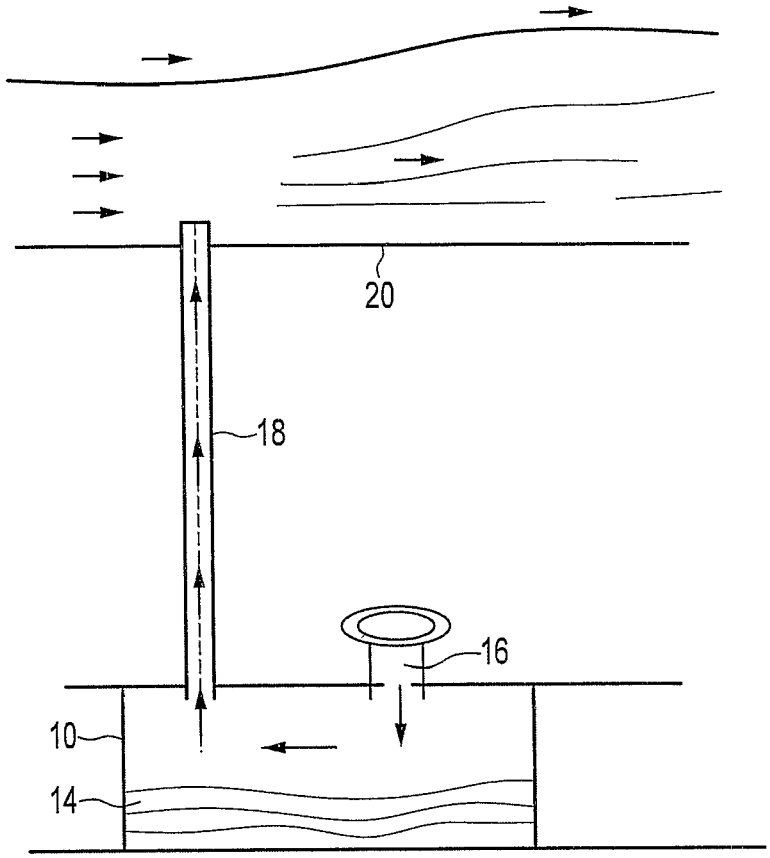
FIG. 7 is a cross-section view showing a recreational vehicle holding tank.
Figure 8:
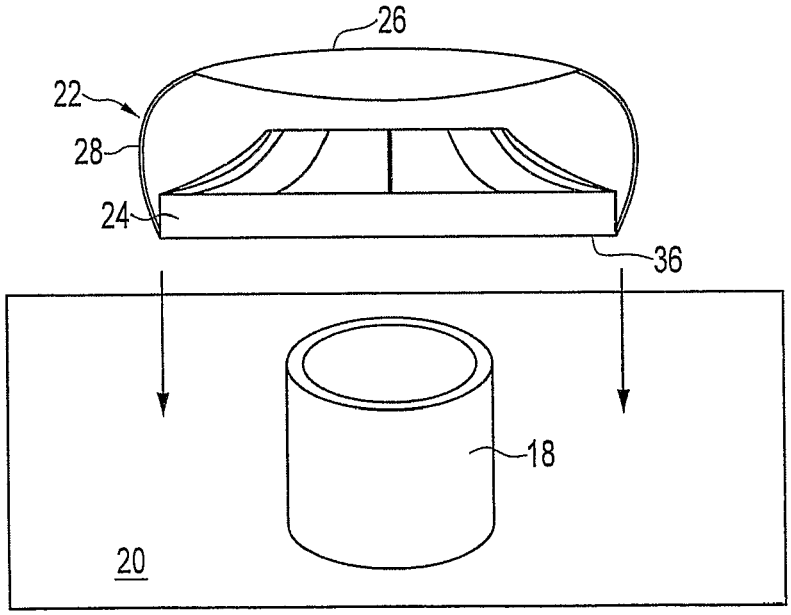
FIG. 8 is a perspective view showing the installation of the vent cap shown in FIG. 2.
Figure 9:
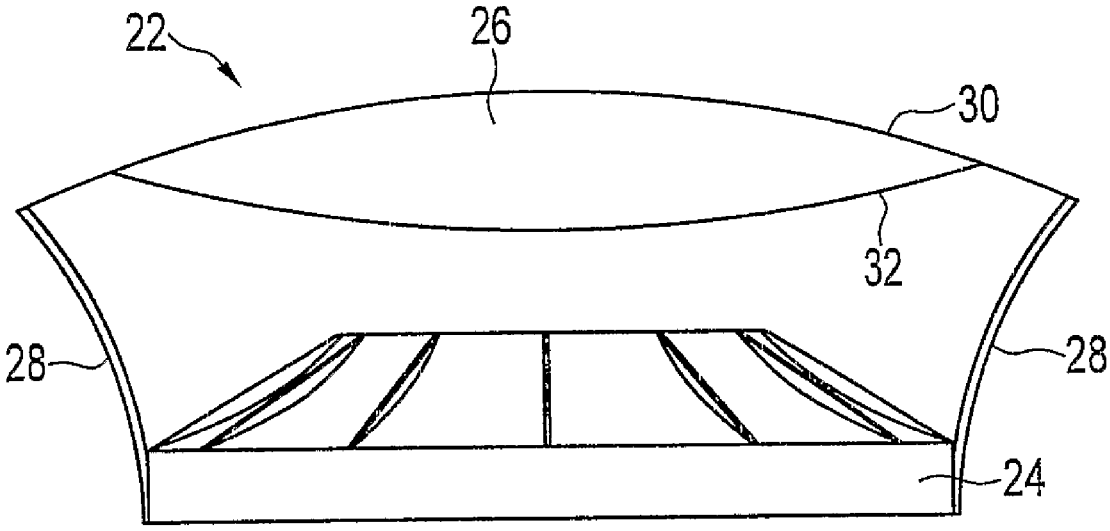
FIG. 9 is a front elevation view of a third embodiment of the vent cap having a further variation in the shape of the support legs.

FIG. 7 illustrates a holding tank 10, containing sewage 14, and having an air inlet 16 and a vent pipe 18 extending through roof 20. The vent cap 22 of the invention is shown in FIG. 1. It has a base 24, top 26 and support legs 28 joining the base 24 and top 26. It is preferably formed of molded plastic but could be constructed of other synthetic or natural materials including wood and metal or combinations of such materials.

Figure 5:
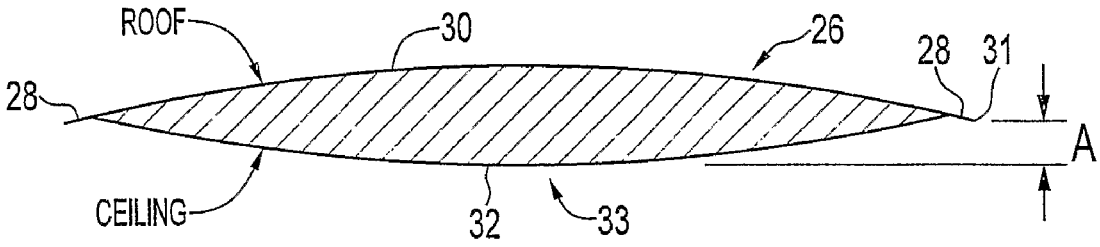
FIG. 5 is a cross-section of the cap shown in FIG. 2 taken along lines 5-5 of FIG. 6.
Figure 6:
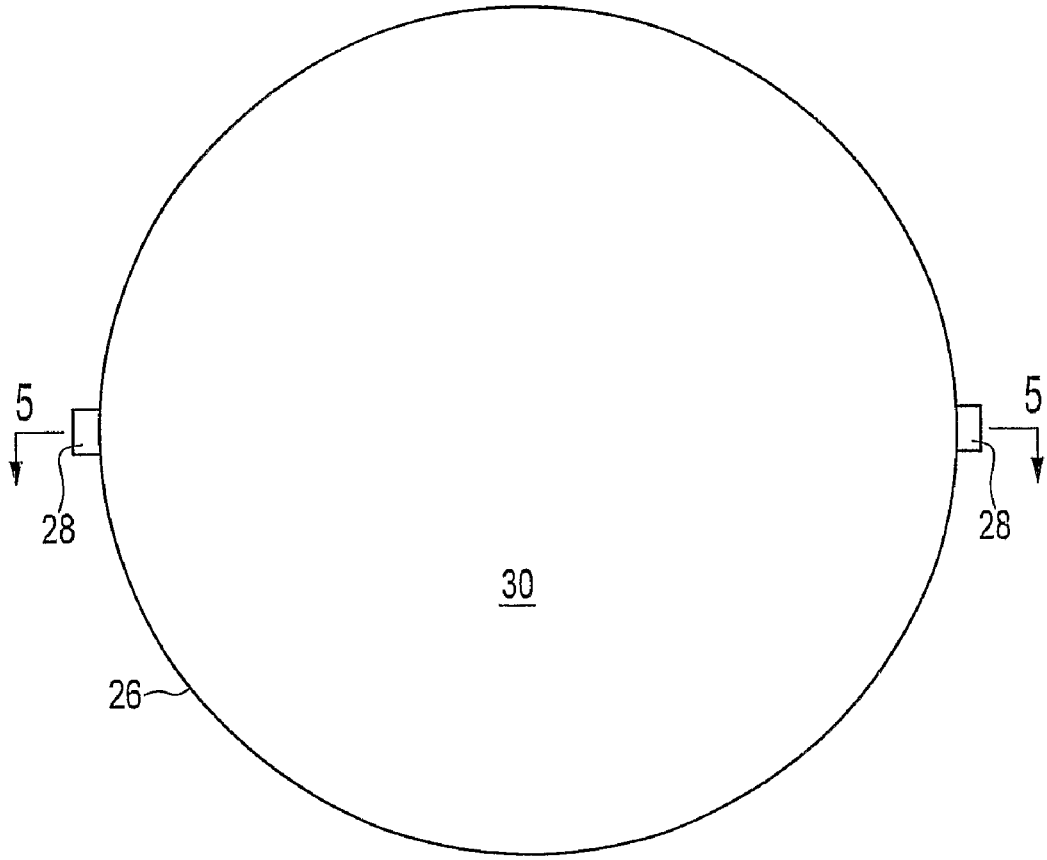
FIG. 6 is a top view of the vent cap shown in FIG. 2.

Top 26, as shown in FIG. 6, serves as a cap to prevent rain or debris from entering vent pipe 18. It has a convex or domed upper surface 30 which provides an aerodynamic shape and permits water and debris to run off. Top 26 has a convex lower surface 32 which forms the upper surface of the channel formed between base 24 and top 26. The central area or apex 33 of convex lower surface 32 (see FIG. 5) extends below the outer edge 31 of upper surface 30 by a distance A. Slender legs 28, that is, legs whose number and thickness are preferably minimized to reduce air turbulence and whose shape is similarly chosen to reduce air turbulence, support top 26 at the appropriate height above base 24. It has been found that a useful minimum separation of base 24 from top 26 is about ½ the length of the ramp surface 40 as described below.

Figure 3:
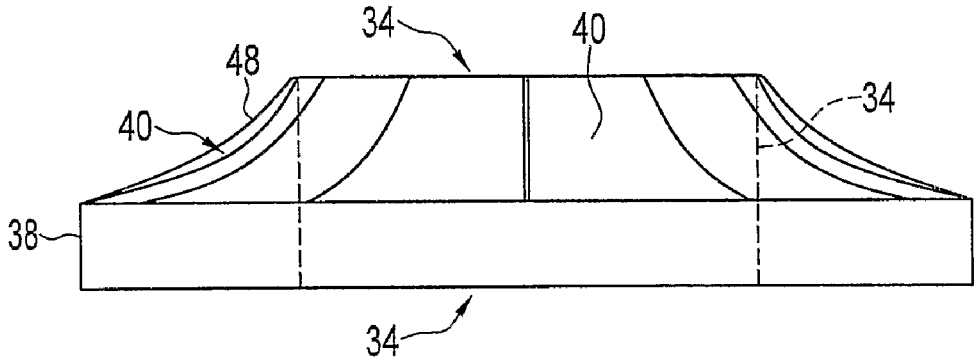
FIG. 3 is a detail view in front elevation of the base of the vent cap shown in FIG. 2.
Figure 4:
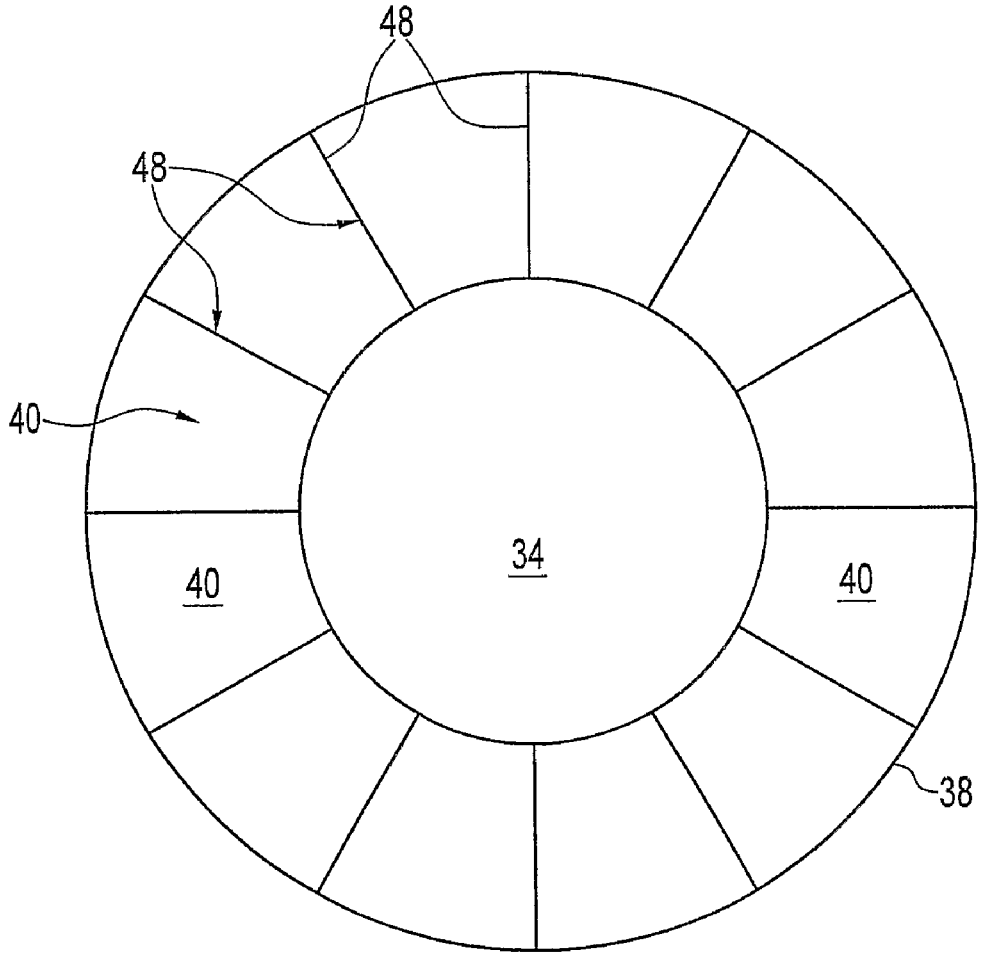
FIG. 4 is a top view of the base shown in FIG. 3.

Base 24, as shown in FIG. 1-4, is circular in top view and has a central cylindrical opening 34 for receiving the vent pipe 18, as shown in dotted outline in FIG. 3. The bottom surface 36 of base 24 is flat. The circular outer circumference of base 24 forms a generally vertical rim or edge 38. A radially extending ramp 40 is formed on the upper surface of base 24 between the outer edge 38 and central opening 34. The surface of ramp 40 is curved, with a smoothly increasing tangential angle, being almost flat at edge 38 to about 80 degrees at opening 34. The vertical height of the ramp rises about one-half its surface distance over the curvature of the ramp from outer to inner edge. The radial length of the ramp is preferably roughly the same as the radius of opening 34. The shape of ramp 40 causes the moving air to be accelerated upwardly away from the exhaust port 34. The shape of ramp 40, in combination with the shape of surface 32, causes a low pressure effect above exhaust port 34 causing the vapors or gasses to be drawn up the stack or chimney from the source to be vented.

To further improve the operation of the device, radial channeling vanes 48 which extend vertically from ramp 40 may be provided. Vanes 48 serve to focus and direct the air flow toward the center of the device, reducing the amount of air that slips around the side of the raised inner area of the device. Due to the radial direction of the vanes, the space between vanes decreases towards the center of the device, thereby funneling, concentrating and magnifying the air flow as it reaches the center of the device, and further increasing the air speed and lowering the air pressure in a zone above exhaust port 34. The height of the vanes 48 above ramp 40 is preferably 5% to 10% of the length of the surface of ramp 40.

In this way a small movement of air can be channeled by the vent cap 22 to significantly reduce the air pressure above exhaust port 34 to draw vapors from holding tank 10 even with light air movement from any direction. Since the device is symmetrical about the central axis the movement of air can be from any direction relative to the device.

Figure 10:
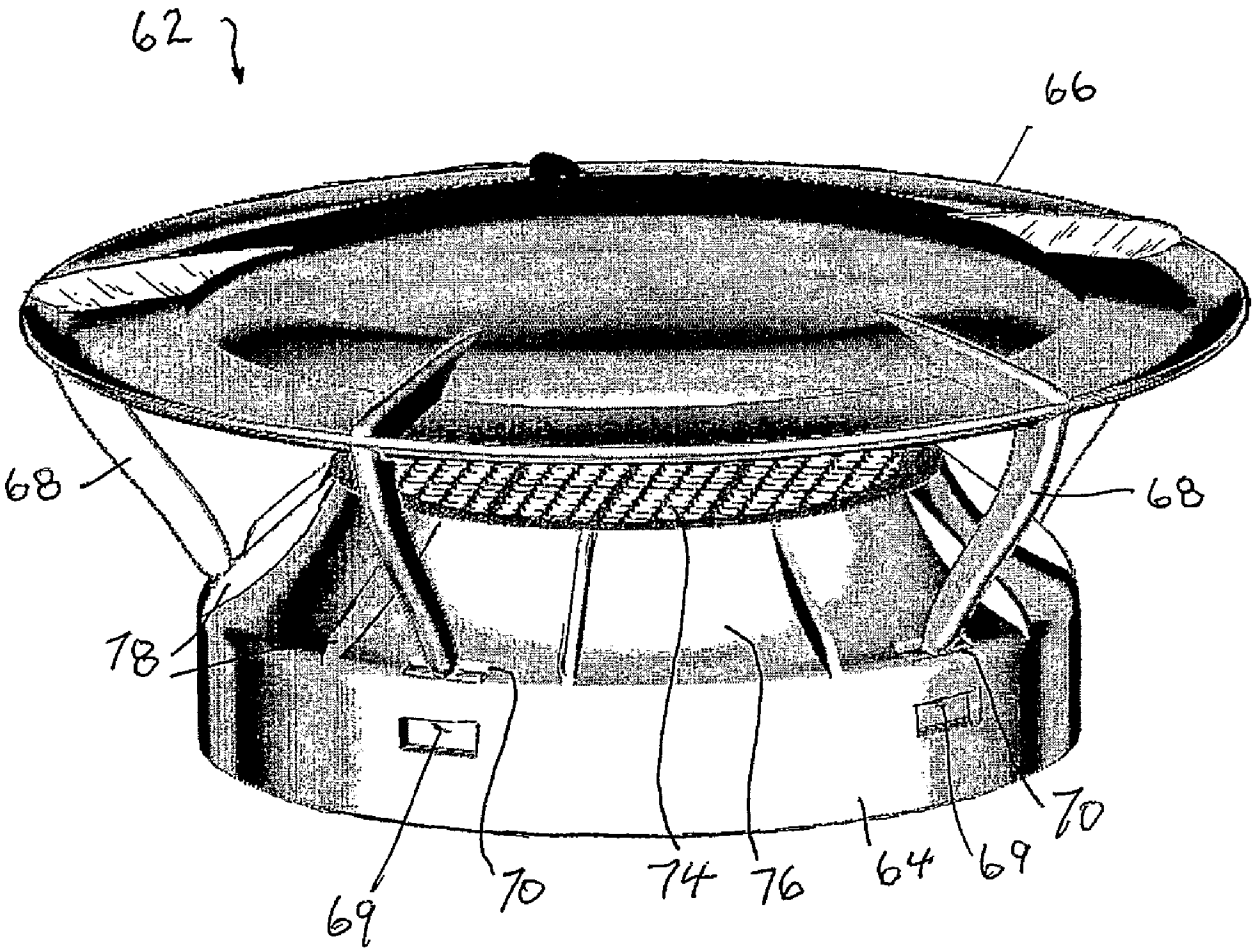
FIG. 10 is a perspective view from above of a fourth embodiment of the invention.
Figure 11:
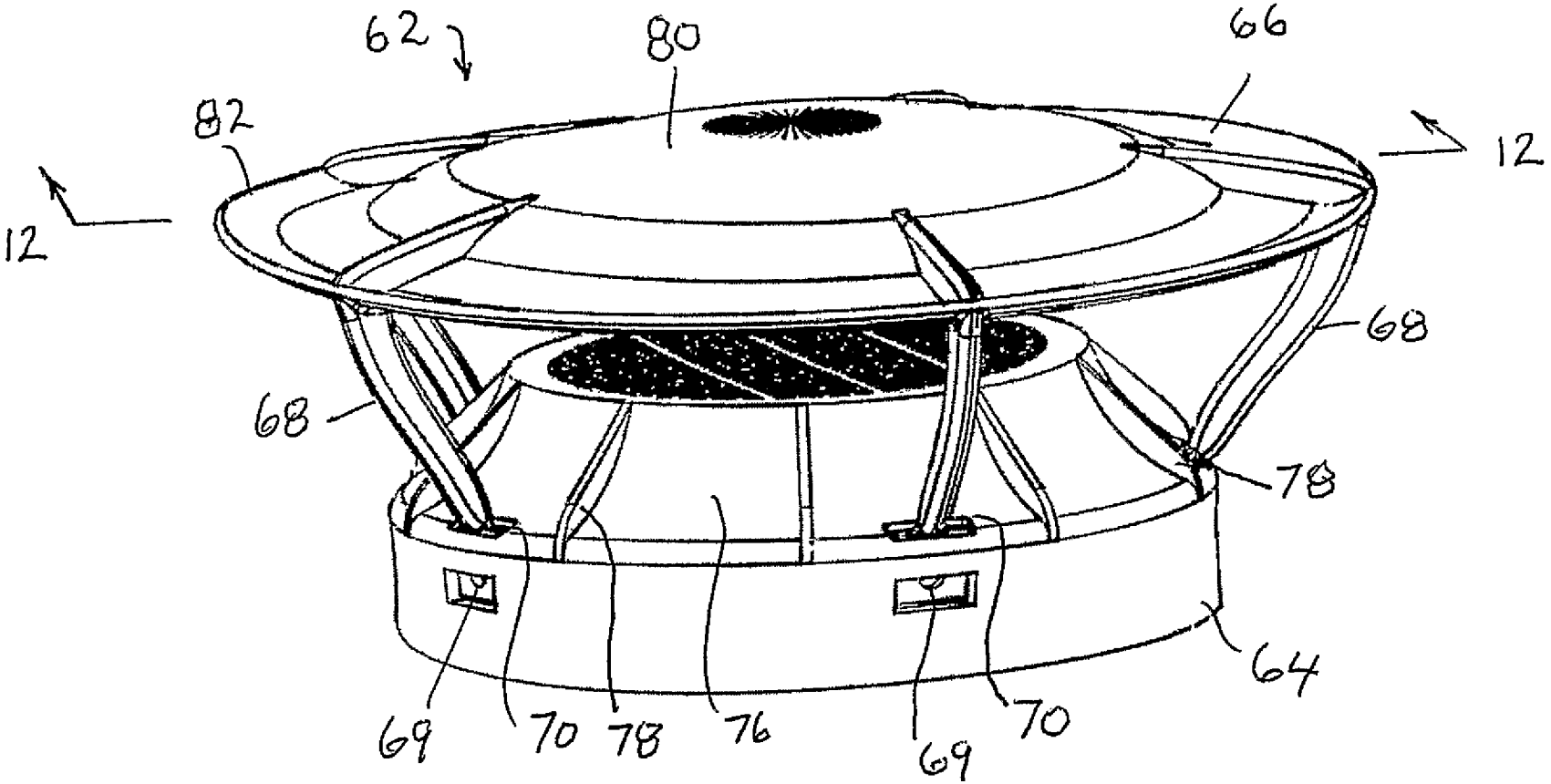
FIG. 11 is a perspective view from above of the embodiment of the invention shown in FIG. 10 rotated slightly.
Figure 12:
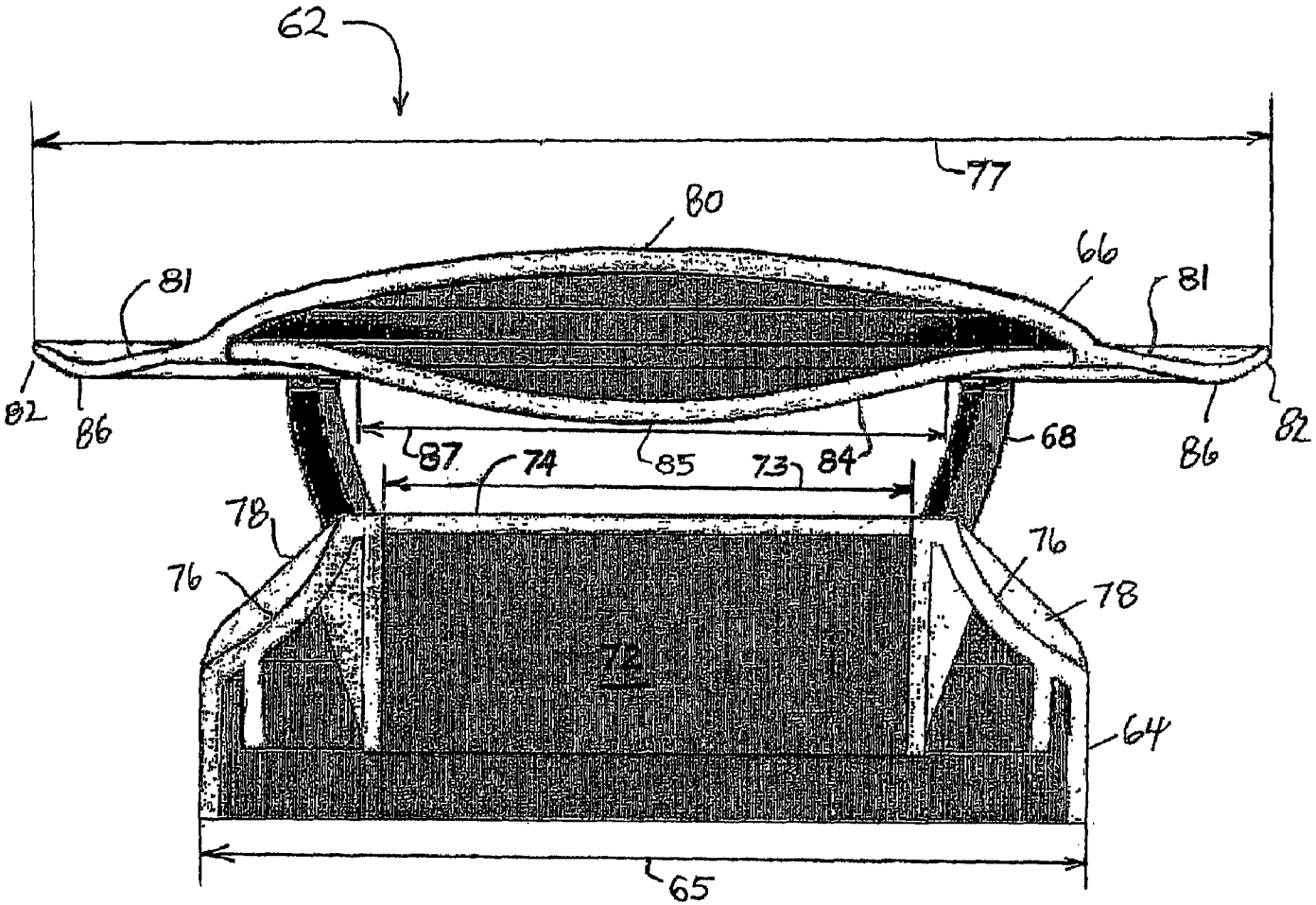
FIG. 12 is a cross-section of the embodiment of the invention shown in FIG. 11 taken along lines 12-12.

FIG. 10-12 illustrate a further embodiment 62 of the vent cap of the invention. It has a base 64 with a diameter 65, a top 66 and slender support legs 68 joining the base 64 and top 66. In this case the legs 68 are formed integrally with the top 66 and have lower ends 69 which snap into apertures 70 in base 64 so that the top 66 can be removed or replaced on base 64. A central opening of channel 72 of base 64 has a diameter 73 and is covered by screen 74. Base 64 has a ramp 76 with radial channeling vanes 78 which extend vertically from ramp 76 as in the previously described embodiments. As shown in FIG. 12, top 66 has a diameter 77 that is at least 30% greater than the diameter 65 of the base 64, and has a convex or domed central upper surface 80 with an annular, thin outer edge portion 81 extending around the convex central upper surface 80 and having a radially outer portion thereof in the form of an upturned outer edge portion 82, giving it a saucer-like appearance. The legs 68 extend from an outer margin of the outer edge portion 81, as seen in FIG. 10. Upturned outer edge portion 82 serves to re-direct down drafts away from the base, creating additional low pressure near the exhaust port and to further gather and concentrate horizontally moving air towards the center of the device. Convex central lower surface portion 84 forms the upper surface of the channel formed between base 64 and top 66 as in the previously-described embodiments, with the central area or apex 85 of convex central lower surface portion 84 extending below the lowest portion 86 of outer edge portion 82. The convex central lower surface portion 84 has a diameter 87 that may be greater than the diameter 73 of the central opening of the channel 72. As is also shown in FIG. 12, a lower surface area surrounding the convex central lower surface portion 84 is an annular shallow downwardly concave lower surface portion 88 of the top 66, and is partly defined by the lower surface of a radially inner part of the annular thin outer edge portion 81, and is circumscribed by the upturned outer edge portion 82.

A particular advantage of the embodiment shown in FIG. 10-12 is that the top 66 can be sold and purchased separately, for example in the event that the top or legs 68 are damaged or broken, without the need to buy or replace the base 64 also.

While the device has been described in the context of a vent cap for a holding tank, it will be apparent to the person skilled in the art that the present invention will have application in other venting applications also including chimneys, other types of roof vents, and other transportation vehicles.

As will be apparent to those skilled in the art in the light of the foregoing disclosure, many alterations and modifications are possible in the practice of this invention. Accordingly, the scope of the invention is to be construed in accordance with the substance defined by the following claims.

What is claimed is:

1. A vent cap for venting an exhaust gas passage, comprising:

i) a base, having a central opening for communicating with said exhaust gas passage, an outer perimeter, and a ramp surface extending between said outer perimeter and said central opening, said ramp surface sloping arcuately upwardly from said outer perimeter to said central opening and having a slope that increases with decreasing distance from the central opening, and a plurality of spaced, radially extending vanes projecting along and upwardly from said ramp surface and above said ramp surface to a distance which is a small fraction of less than the length of said ramp surface, but not projecting higher than an upper end of said ramp;

ii) a top cover element supported above said base, the top cover element having a diameter greater than a diameter of said base, and the top cover element having a convex central upper surface, an annular thin outer edge portion extending around said convex central upper surface, and a convex central lower surface portion extending at its lowest point below a lowest part of said annular thin outer edge portion, and wherein said annular thin outer edge portion of said top cover element extends radially and has a radially outer portion that turns arcuately upwardly in an upwardly concave saucer-like, form to thereby in combination with said base cause a low pressure zone above said central opening in air moving horizontally through said vent cap; and iii) a plurality of slender legs supporting said top cover element above said base, each of said legs extending from said outer perimeter of said base to an outer margin of said annular thin outer edge portion.

2. The vent cap of claim 1 wherein said top cover element and said base have a minimum separation of approximately ½ the radial length of said ramp surface.

3. The vent cap of claim 1 wherein said ramp surface is curved with a continuously increasing tangential angle, proceeding from said outer perimeter towards said central opening.

4. The vent cap of claim 3 wherein said ramp surface is approximately horizontal at its outer edge and has a slope of about 80 degrees adjacent the central opening.

5. The vent cap of claim 1 wherein said ramp surface extends upward about one-half its surface distance radially along the curvature of the ramp from the outer perimeter to an inner edge of said ramp surface.

6. The vent cap of claim 5 wherein a radial length of said ramp surface is approximately the same as a radius of said central opening.

7. The vent cap of claim 1 wherein said top cover element is releasably secured to said base by the lower end of said legs being releasably received in apertures in said base.

8. The vent cap of claim 1 wherein said distance to which said vanes project upwardly is 5% to 10% of said length of said ramp surface.

9. The vent cap of claim 1 wherein said top cover element has an annular shallow downwardly concave lower surface portion surrounding said convex central lower surface portion and circumscribed by said radially outer portion of said annular thin outer edge portion.

10. The vent cap of claim 9 wherein said convex central lower surface portion of said top cover element has a diameter at least equal to said diameter of said central opening of said base.

11. The vent cap of claim 1 wherein said diameter of said top cover element is at least about 30% greater than said diameter of said base.

* * * * *